US007823350B2

(12) United States Patent
Valle et al.

(10) Patent No.: US 7,823,350 B2
(45) Date of Patent: Nov. 2, 2010

(54) STRUCTUAL STUD

(75) Inventors: John J. Valle, Laredo, TX (US); Kenneth A. Valls, Laredo, TX (US); Jose R. Medina, Laredo, TX (US); Abdiel Daniel Guajardo, Laredo, TX (US)

(73) Assignee: Hi-Tech Tilt Intellectual Property Management, Inc., Laredo, TX (US)

( * ) Notice: Subject to any disclaimer, the term of this patent is extended or adjusted under 35 U.S.C. 154(b) by 0 days.

(21) Appl. No.: 11/673,356

(22) Filed: Feb. 9, 2007

(65) Prior Publication Data

US 2007/0245657 A1 Oct. 25, 2007

Related U.S. Application Data

(60) Provisional application No. 60/772,106, filed on Feb. 10, 2006.

(51) Int. Cl.
*E04C 2/38* (2006.01)

(52) U.S. Cl. ..... 52/356; 52/351; 52/855; 52/443

(58) Field of Classification Search ..... 52/344, 52/351, 352, 356, 702, 454, 855, 831, 343, 52/334, 443, 846, 414, FOR. 100, FOR. 131, 52/FOR. 147; 248/217.2, 911, 912; 211/72, 211/73

See application file for complete search history.

(56) References Cited

U.S. PATENT DOCUMENTS 682,316 A * 9/1901 Caldwell ..... 52/356
717,923 A * 1/1903 Rapp ..... 52/356
802,727 A * 10/1905 Alschuler ..... 52/675
855,240 A 5/1907 Forsyth ..... 52/671
1,004,859 A 10/1911 Dowd ..... 52/349
1,685,247 A * 9/1928 Selway ..... 52/356
1,814,202 A 7/1931 Winget ..... 403/274
1,815,065 A * 7/1931 Lucy ..... 52/349
1,885,883 A 11/1932 Young ..... 52/334
1,938,871 A * 12/1933 Smith ..... 24/295
1,946,690 A * 2/1934 Haines ..... 52/386
1,960,961 A * 5/1934 Thomas ..... 52/356
2,014,419 A * 9/1935 Voigt ..... 52/461
2,027,799 A * 1/1936 Wharton ..... 211/70.7
2,044,216 A * 6/1936 Klages ..... 52/774
2,209,514 A * 7/1940 Drummond ..... 52/223.13
2,590,807 A * 3/1952 Voslamber ..... 29/21.1
3,108,406 A * 10/1963 Ellis ..... 52/577

(Continued)

FOREIGN PATENT DOCUMENTS

DE 413 234 9/1925

(Continued)

OTHER PUBLICATIONS

International Preliminary Report on Patentability, issued in Application No. PCT/US2007/061935, dated Aug. 21, 2008.

(Continued)

*Primary Examiner*—Robert J Canfield
*Assistant Examiner*—Jessie Fonseca
(74) *Attorney, Agent, or Firm*—Fulbright & Jaworski

(57) ABSTRACT

Embodiments of a structural stud and panel for use in building a tilt-wall building are disclosed. Devices and methods for forming structural studs and panels are also disclosed.

6 Claims, 11 Drawing Sheets

U.S. PATENT DOCUMENTS

| | | | | | |
|---|---|---|---|---|---|
| 3,236,932 | A | * | 2/1966 | Grigas et al. | 52/543 |
| 3,303,627 | A | | 2/1967 | Mora | 52/724.1 |
| 3,312,032 | A | | 4/1967 | Ames | 52/580 |
| 3,802,147 | A | * | 4/1974 | O'Konski | 52/630 |
| 3,839,839 | A | * | 10/1974 | Tillisch et al. | 52/846 |
| 3,896,650 | A | | 7/1975 | O'Konski | 72/186 |
| 3,940,899 | A | * | 3/1976 | Balinski | 52/481.1 |
| D257,709 | S | * | 12/1980 | Lewis | D8/381 |
| 4,753,053 | A | * | 6/1988 | Heard | 52/712 |
| 4,763,867 | A | * | 8/1988 | Hungerford, Jr. | 248/544 |
| 4,856,246 | A | * | 8/1989 | Shimasaki | 52/386 |
| 4,885,884 | A | * | 12/1989 | Schilger | 52/354 |
| 4,918,894 | A | * | 4/1990 | Page | 52/506.02 |
| 4,930,278 | A | | 6/1990 | Staresina | 52/315 |
| 5,060,434 | A | * | 10/1991 | Allison | 52/238.1 |
| 5,390,457 | A | * | 2/1995 | Sjolander | 52/387 |
| 5,414,972 | A | | 5/1995 | Ruiz et al. | 52/600 |
| 5,676,486 | A | * | 10/1997 | Keith | 403/231 |
| 5,697,506 | A | * | 12/1997 | Peickert | 211/71.01 |
| 5,743,497 | A | * | 4/1998 | Michael | 248/68.1 |
| 5,953,876 | A | * | 9/1999 | Agar | 52/489.1 |
| 6,151,858 | A | * | 11/2000 | Ruiz et al. | 52/481.1 |
| 6,401,423 | B1 | * | 6/2002 | Bergeron et al. | 52/855 |
| 6,631,589 | B1 | * | 10/2003 | Friedman et al. | 52/30 |
| 6,647,691 | B2 | | 11/2003 | Becker et al. | 52/656.1 |
| 6,708,459 | B2 | | 3/2004 | Bodnar | 52/340 |
| 6,845,594 | B2 | | 1/2005 | Harber | 52/702 |
| 7,051,484 | B2 | * | 5/2006 | Nanayakkara | 52/481.1 |
| 7,278,244 | B1 | * | 10/2007 | Rubio | 52/600 |
| 2002/0194812 | A1 | | 12/2002 | Attalla | 52/731.9 |
| 2005/0055967 | A1 | | 3/2005 | Kariakin | 52/720.1 |
| 2006/0144009 | A1 | * | 7/2006 | Attalla | 52/720.1 |
| 2007/0245657 | A1 | | 10/2007 | Valle et al. | 52/356 |

FOREIGN PATENT DOCUMENTS

| | | |
|---|---|---|
| EP | 0 992 301 | 4/2000 |
| FR | 2 213 202 | 8/1974 |
| GB | 2 019 469 | 10/1979 |
| JP | 2005-331562 A | 12/2005 |

OTHER PUBLICATIONS

International Search Report and Written Opinion, issued in Application No. PCT/2007/061935, dated Jul. 9, 2007.

International Search Report and Written Opinion, in Int. App. No. PCT/US2009/050536, mailed Feb. 25, 2010.

* cited by examiner

STRUCTUAL STUD

This application claims the benefit of priority to U.S. Provisional Patent Application No. 60/772,106 filed on Feb. 10, 2006, which is hereby incorporated by reference in its entirety.

BACKGROUND OF THE INVENTION

1. Field of the Invention

The present invention generally relates to the field of building construction. More particularly, the present invention relates to devices and methods for building a tilt-wall building.

2. Related Art

The building and construction industry has previously employed a technique for forming walls in which structural studs are embedded in concrete. A primary challenge with this technique is to embed the studs in concrete in such a way as to minimize or eliminate any separation between the studs and the concrete once the wall is formed. One means of addressing this challenge has been through the design of the structural studs themselves.

U.S. Pat. No. 6,151,858 to Ruiz, et al. ("Ruiz") discloses an example of one such design for a structural stud. The stud disclosed in Ruiz has a number of tabs extending outwardly from the side walls of the stud, and each of the tabs is derived as a cut-out portion of the side wall. The tabs are L-shaped and are folded out from the side wall along a bend line that is generally at right angles to the longitudinal axis of the stud. One problem with the machinery needed to form the tabs in Ruiz is that two strikes are required to form the tabs: one strike to punch the tab out of the side wall and another strike to form the L-shape in the tab.

U.S. Publication No. 2005/0055967 to Kariakin ("Kariakin") discloses an example of another design for a structural stud. Kariakin describes a number of problems with the design disclosed in Ruiz, including that the L-shaped tabs are difficult to punch out from the side wall of the stud due to the extreme right angle required which joins the two legs of the L-shape together. Kariakin also discloses that another problem with the L-shaped tab design is that the surrounding concrete does not completely engage the tab surface area, particularly around the right angle joint. Kariakin attempts to overcome these problems by employing tabs that are substantially curved in side elevational view such that the tabs are half U-shaped. The tabs in Kariakin are said to be formed by means of a rolling guide with a punch that pierces a portion of the side wall in order to force the section outward to define the tab.

What is needed is a structural stud that provides improved adhesion between the stud and the surrounding concrete such that separation between the stud and the concrete is further minimized in comparison to the examples disclosed above and elsewhere in the prior art. What is further needed is a structural stud which can be formed by a device and a process that is less expensive and has less problems than the devices and processes by which other studs are formed.

The referenced shortcomings are not intended to be exhaustive, but rather are among many that tend to impair the effectiveness of previously known techniques for designing structural studs; however, those mentioned here are sufficient to demonstrate that the methodologies appearing in the art have not been altogether satisfactory and that a significant need exists for the techniques described and claimed in this disclosure.

SUMMARY

Embodiments of the present invention include a structural stud that allows for improved adhesion between the stud and the surrounding concrete. A further benefit of the structural stud of certain embodiments of the present invention is that it can be formed by a device and a process that is less expensive and has less problems than the devices and processes by which other studs are formed. In certain embodiments, the structural stud of the present invention comprises a stud having a sidewall and a tab punched out of the sidewall, the tab comprising: a tab leg that is substantially planar and is connected to the sidewall at one end of the tab leg, and that projects outwardly from the sidewall at an angle of less than ninety degrees to the sidewall; and a tab foot extending from the tab leg and curving either away from or toward a hole in the sidewall created by the tab punched out of the sidewall. In some embodiments, the hole in the sidewall is defined by a base side and a top side, the base side has a greater length than the top side, and the tab leg extends from the base side. In certain embodiments, the structural stud comprises a plurality of tabs. In still other embodiments, the plurality of tabs is spaced such that the gap between successive tab leg connections to the sidewall is less than about six inches. In other embodiments, the gap between successive tab leg connections to the sidewall is about four inches.

Embodiments of the present invention also include a method of forming a structural stud comprising obtaining a stud having a sidewall; striking the sidewall of the stud with a punch; and forcing the punch into a die, creating a tab punched out of the sidewall, the tab comprising: a tab leg that is substantially planar and is connected to the sidewall at one end of the tab leg, and that projects outwardly from the sidewall at an angle of less than ninety degrees to the sidewall; and a tab foot extending from the tab leg and curving either away from or toward a hole in the sidewall created by the tab punched out of the sidewall. In some embodiments, the hole created in the sidewall is defined by a base side and a top side, the base side has a greater length than the top side, and the tab leg extends from the base side. In other embodiments, the sidewall of the stud is struck with a plurality of punches, creating a plurality of tabs in the sidewall. In certain embodiments, the plurality of tabs is spaced such that the gap between successive tab leg connections to the sidewall is less than about six inches. In still other embodiments, the gap between successive tab leg connections to the sidewall is about four inches. In yet another embodiment, the tab is created in one strike of the sidewall with the punch.

Embodiments of the present invention also include a device for forming a structural stud comprising a punch for striking a sidewall of the stud and a die into which the punch is forced, where striking the sidewall with the punch and forcing the punch into the die creates a tab punched out of the sidewall, the tab comprising: a tab leg that is substantially planar and is connected to the sidewall at one end of the tab leg, and that projects outwardly from the sidewall at an angle of less than ninety degrees to the sidewall; and a tab foot extending from the tab leg and curving either away from or toward a hole in the sidewall created by the tab punched out of the sidewall. In some embodiments, the hole in the sidewall is defined by a base side and a top side, the base side has a greater length than the top side, and the tab leg extends from the base side. In other embodiments, the device comprises a plurality of punches and dies and creates a plurality of tabs in the sidewall. In certain embodiments, the plurality of tabs is spaced such that the gap between successive tab leg connections to the sidewall is less than about six inches. In still other embodiments, the gap between successive tab leg connections to the sidewall is about four inches. In yet another embodiment, the device is capable of creating the tab in one strike of the sidewall with the punch.

Embodiments of the present invention also include a method of building a tilt-wall building comprising: obtaining a plurality of structural studs, each stud comprising: a stud having a sidewall; and a tab punched out of the sidewall, the tab comprising: a tab leg that is substantially planar and is connected to the sidewall at one end of the tab leg, and that projects outwardly from the sidewall at an angle of less than ninety degrees to the sidewall; and a tab foot extending from the tab leg and curving either away from or toward a hole in the sidewall created by the tab punched out of the sidewall; combining the plurality of structural studs with a structural mesh on a substantially horizontal surface such that the studs and mesh are substantially parallel to each other and to the substantially horizontal surface and there are voids formed between the structural studs; embedding the structural studs and structural mesh in concrete to form a panel; and raising the panel such that it is substantially perpendicular to the ground. In some embodiments, the method further comprises laying lifting anchors in the voids formed between the structural studs prior to embedding the structural studs and structural mesh in concrete; embedding the structural studs, structural mesh, and lifting anchors in concrete to form a panel, such that a portion of each lifting anchor is exposed; and using the lifting anchors to raise the panel. In other embodiments, the method further comprises laying support anchors in the voids formed between the structural studs prior to embedding the structural studs and structural mesh in concrete; embedding the structural studs, structural mesh, and support anchors in concrete to form a panel, such that a portion of each support anchor is exposed; and attaching supports to the support anchors.

Embodiments of the present invention also include a panel comprising a plurality of structural studs, each stud comprising a stud having a sidewall; and a tab punched out of the sidewall, the tab comprising: a tab leg that is substantially planar and is connected to the sidewall at one end of the tab leg, and that projects outwardly from the sidewall at an angle of less than ninety degrees to the sidewall; and a tab foot extending from the tab leg and curving either away from or toward a hole in the sidewall created by the tab punched out of the sidewall; and a structural mesh, where the plurality of structural studs and the structural mesh are embedded in concrete. In some embodiments, the panel further comprises at least one lifting anchor embedded in the concrete, while in other embodiments the panel further comprises at least one support anchor embedded in the concrete.

In other embodiments, the present invention comprises a structural stud comprising: a stud having a sidewall; a vertical tab punched out of the sidewall and a vertical hole resulting from the vertical tab, the tab comprising a tab leg that is substantially planar and is connected to the sidewall at one end of the tab leg, and that projects outwardly from the sidewall at an angle of less than ninety degrees to the sidewall; and a tab foot extending from the tab leg of the vertical tab punched out of the sidewall and curving either away from or toward the vertical hole in the sidewall resulting from the vertical tab punched out of the sidewall; and a horizontal tab punched out of the sidewall and a horizontal hole resulting from the horizontal tab, the tab comprising a tab leg that is substantially planar and is connected to the sidewall at one end of the tab leg, and that projects outwardly from the sidewall at an angle of less than ninety degrees to the sidewall; a tab foot extending from the tab leg of the horizontal tab punched out of the sidewall and curving either away from or toward the horizontal hole in the sidewall resulting from the vertical tab punched out of the sidewall; where the end of vertical tab that is connected to the sidewall is substantially perpendicular to the end of the horizontal tab that is connected to the sidewall.

In another embodiment, the vertical hole is defined by a base side and a top side, the base side has a greater length than the top side, and the vertical tab leg extends from the base side; and the horizontal hole is defined by a base side and a top side, the base side has a greater length than the top side, and the horizontal tab leg extends from the base side.

In other embodiments, the structural stud comprises a plurality of vertical tabs and resulting vertical holes and horizontal tabs and resulting horizontal holes. In another embodiment, the vertical tabs and vertical holes and the horizontal tabs and horizontal holes are positioned in an alternating arrangement on the sidewall such that there is a horizontal tab and horizontal hole between each vertical tab and vertical hole. In yet another embodiment, the horizontal holes and the vertical holes are spaced such that the distance between the centers of successive vertical and horizontal holes is less than about 6 inches. In still another embodiment, the horizontal holes and the vertical holes are spaced such that the distance between the centers of successive vertical and horizontal holes is about 4 inches.

In other embodiments, the present invention comprises a method of building a tilt-wall building comprising: obtaining a plurality of structural studs, each stud comprising: a stud having a sidewall; a vertical tab punched out of the sidewall and a vertical hole resulting from the vertical tab, the tab comprising a tab leg that is substantially planar and is connected to the sidewall at one end of the tab leg, and that projects outwardly from the sidewall at an angle of less than ninety degrees to the sidewall; and a horizontal tab punched out of the sidewall and a horizontal hole resulting from the horizontal tab, the tab comprising a tab leg that is substantially planar and is connected to the sidewall at one end of the tab leg, and that projects outwardly from the sidewall at an angle of less than ninety degrees to the sidewall; where the end of vertical tab that is connected to the sidewall is substantially perpendicular to the end of the horizontal tab that is connected to the sidewall; combining the plurality of structural studs with a structural mesh on a substantially horizontal surface such that the studs and mesh are substantially parallel to each other and to the substantially horizontal surface and there are voids formed between the structural studs; embedding the structural studs and structural mesh in concrete to form a panel; and raising the panel such that it is substantially perpendicular to the ground.

In still other embodiments, the present invention comprises a panel comprising: a plurality of structural studs, each stud comprising: a stud having a sidewall; a vertical tab punched out of the sidewall and a vertical hole resulting from the vertical tab, the tab comprising a tab leg that is substantially planar and is connected to the sidewall at one end of the tab leg, and that projects outwardly from the sidewall at an angle of less than ninety degrees to the sidewall; and a horizontal tab punched out of the sidewall and a horizontal hole resulting from the horizontal tab, the tab comprising a tab leg that is substantially planar and is connected to the sidewall at one end of the tab leg, and that projects outwardly from the sidewall at an angle of less than ninety degrees to the sidewall; where the end of vertical tab that is connected to the sidewall is substantially perpendicular to the end of the horizontal tab that is connected to the sidewall; and a structural mesh, where the plurality of structural studs and the structural mesh are embedded in concrete.

Descriptions of well known processing techniques, components, and equipment are omitted so as not to unnecessarily obscure the present methods and devices in unnecessary detail. The descriptions of the present methods and devices are exemplary and non-limiting. Certain substitutions, modifications, additions and/or rearrangements falling within the scope of the claims, but not explicitly listed in this disclosure, may become apparent to those or ordinary skill in the art based on this disclosure.

Additional embodiments of the present invention, and details associated with those embodiments, are described below.

BRIEF DESCRIPTION OF THE DRAWINGS

The following drawings illustrate by way of example and not limitation. Identical reference numerals do not necessarily indicate an identical structure. Rather, the same reference numeral may be used to indicate a similar feature or a feature with similar functionality. Every feature of each embodiment is not always labeled in every figure in which that embodiment appears, in order to keep the embodiments clear. The drawings form part of the present specification and are included to further demonstrate certain aspects of the present invention. The invention may be better understood by reference to one or more of these drawings in combination with the description of illustrative embodiments presented herein.

DESCRIPTION OF ILLUSTRATIVE EMBODIMENTS

Figure 1:
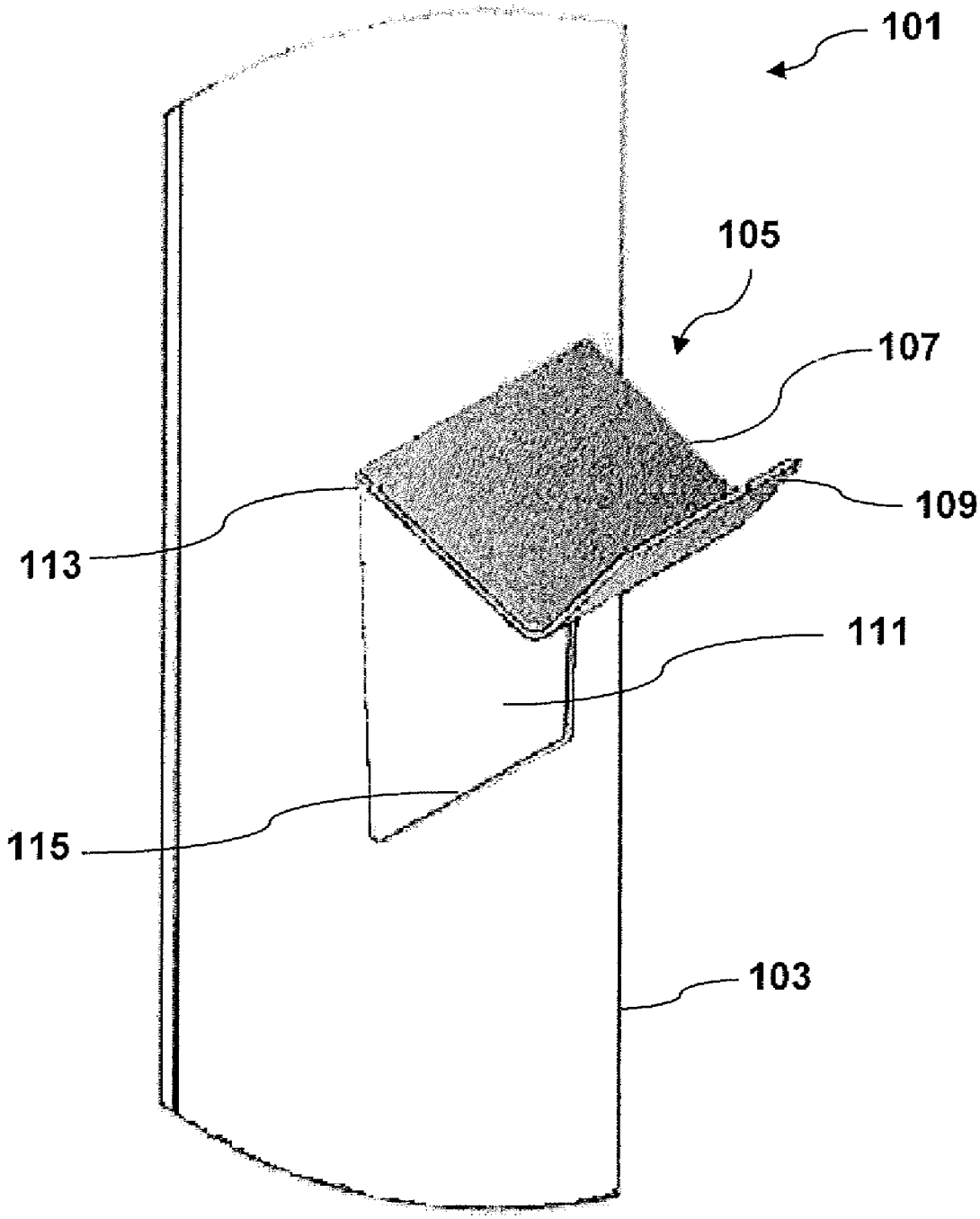
FIG. 1 is a partial isometric view of one embodiment of the present structural studs.
Figure 2:
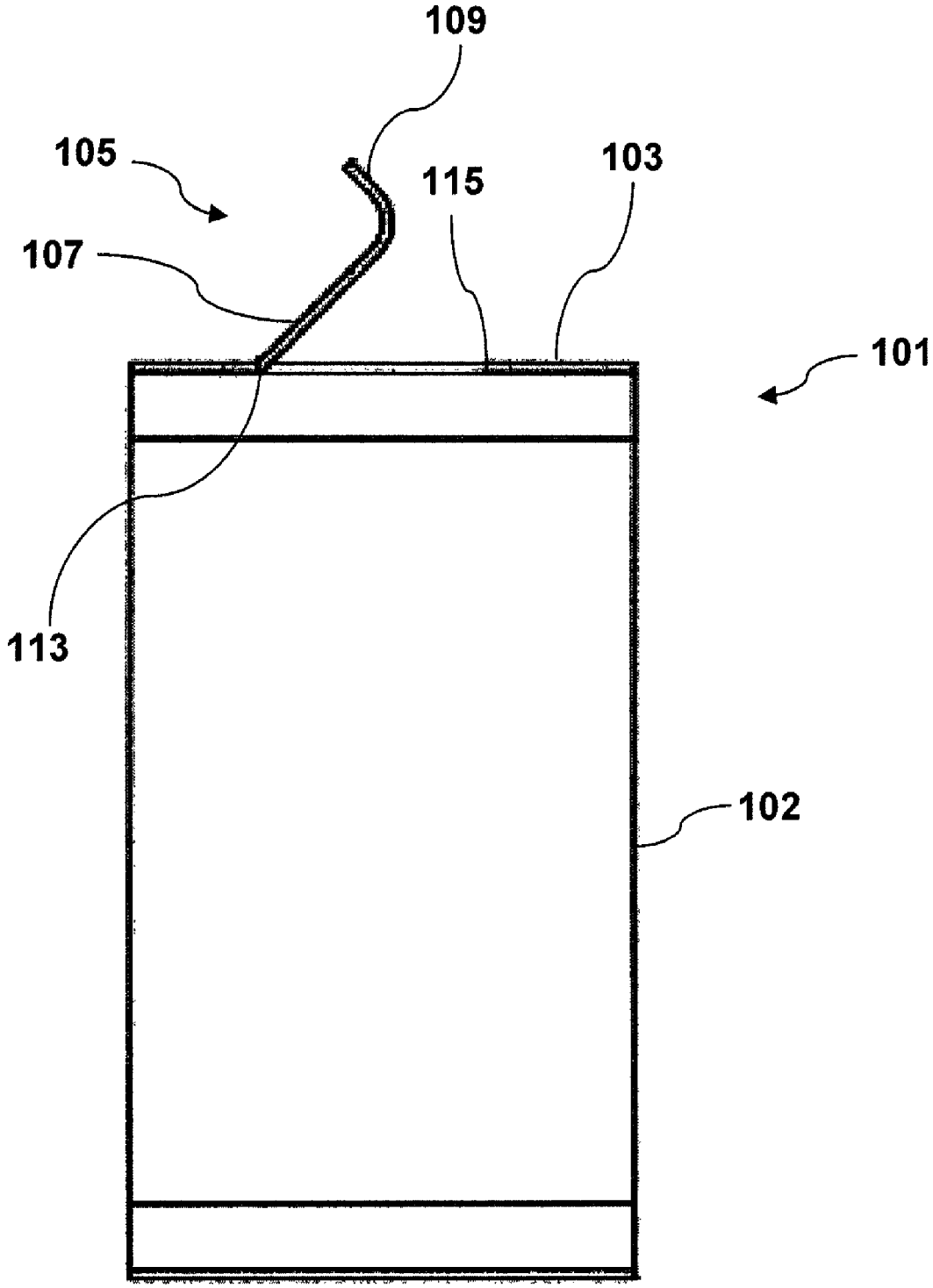
FIG. 2 is a side view of one embodiment of the present structural studs.
Figure 3:
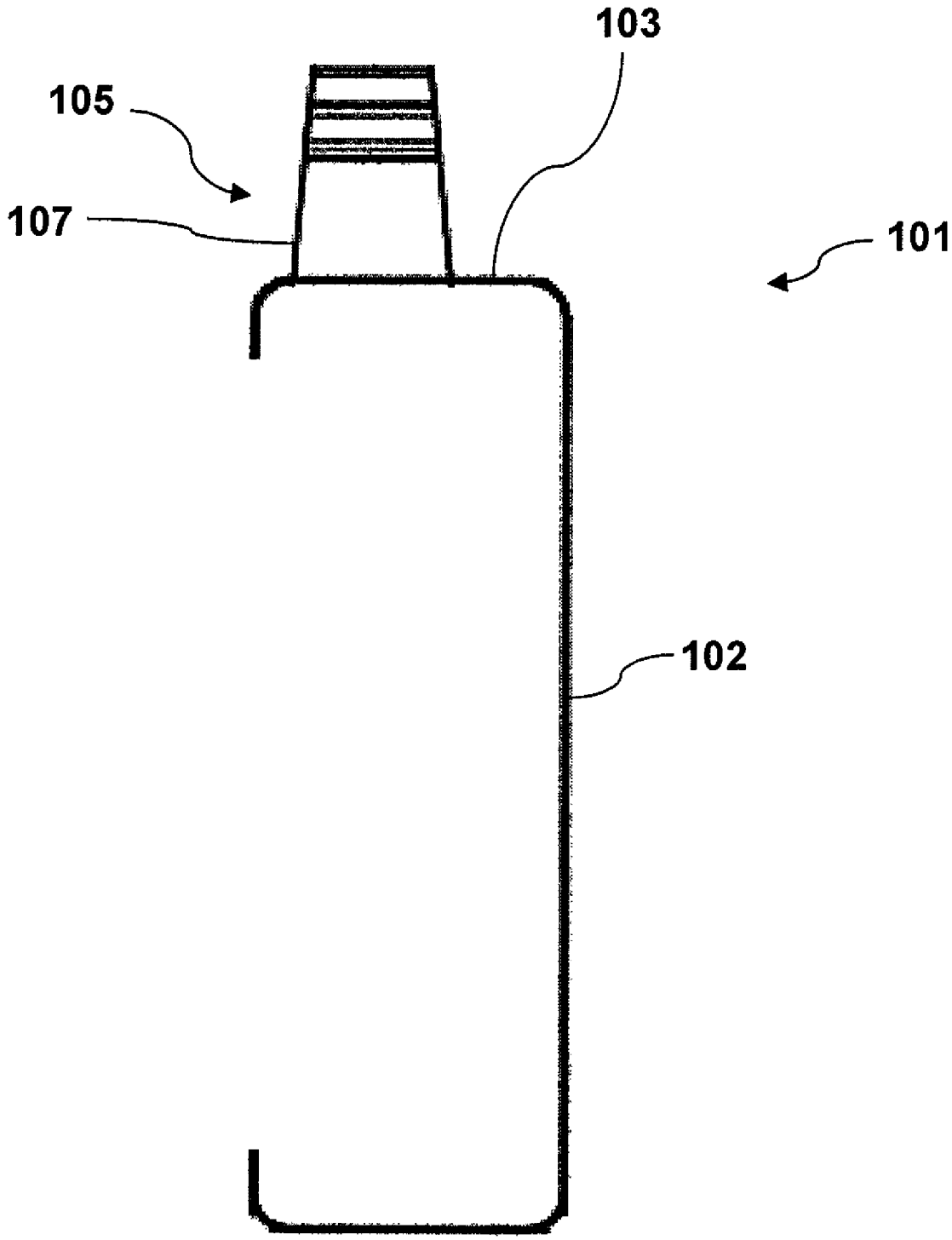
FIG. 3 is a front view of one embodiment of the present structural studs.
Figure 4:
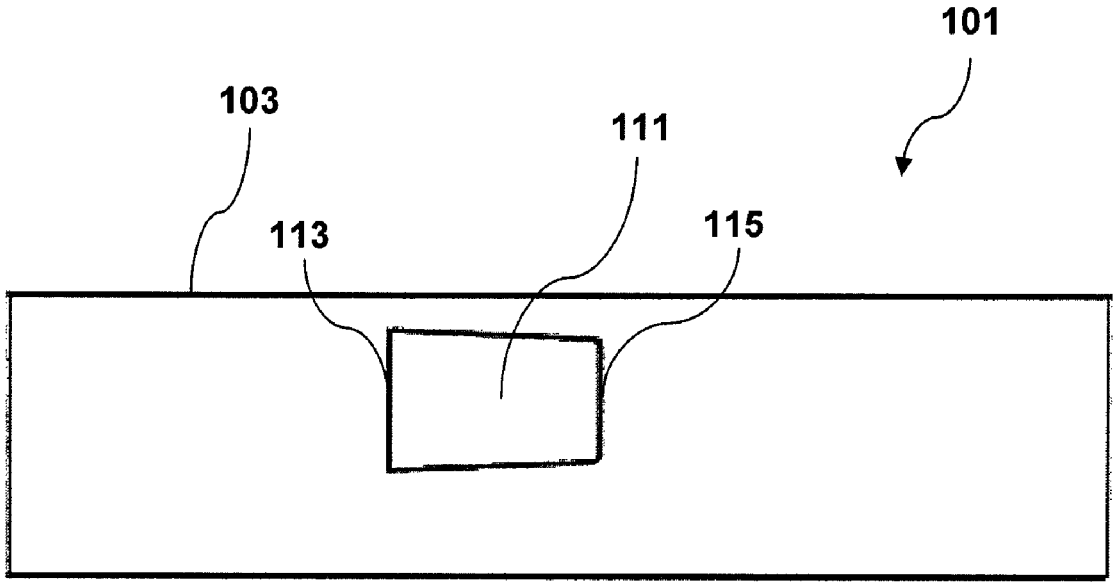
FIG. 4 is a top view of one embodiment of the present structural studs.

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a structural stud, device, or method that "comprises," "has," "contains," or "includes" one or more elements possesses those one or more elements, but is not limited to possessing only those one or more elements or steps. Likewise, an element of a structural stud, device, or method that "comprises," "has," "contains," or "includes" one or more features possesses those one or more features, but is not limited to possessing only those one or more features. Furthermore, a structure that is configured in a certain way must be configured in at least that way, but also may be configured in a way or ways that are not specified.

The terms "a" and "an" are defined as one or more than one unless this disclosure explicitly requires otherwise. The terms "substantially" and "about" are defined as at least close to (and includes) a given value or state (preferably within 10% of, more preferably within 1% of, and most preferably within 0.1% of).

One embodiment of the present invention is the version of the present structural stud shown in FIGS. 1-4. The structural stud comprises a stud 101 having a baseplate 102, a sidewall 103 connected to the baseplate 102, and a tab 105 punched out of the sidewall. The tab 105 comprises a tab leg 107 that is substantially planar and is connected to the sidewall 103 at one end of the tab leg 107. The tab leg 107 projects outwardly from the sidewall 103 at an angle of less than ninety degrees to the sidewall 103. Having the tab leg 107 project outwardly at an angle of less than ninety degrees results in improved adhesion between the structural stud and the surrounding concrete. The tab 105 also comprises a tab foot 109 extending from the tab leg 107 and curving away from a hole 111 in the sidewall 103 created by the tab 105 punched out of the sidewall 103. Having the tab foot 109 curve away from the hole 111 in the sidewall 103 further results in improved adhesion between the structural stud and the surrounding concrete. In some embodiments, the hole 111 in the sidewall 103 is defined by a base side 113 and a top side 115, the base side has a greater length than the top side, and the tab leg 107 extends from the base side 113.

Figure 5:
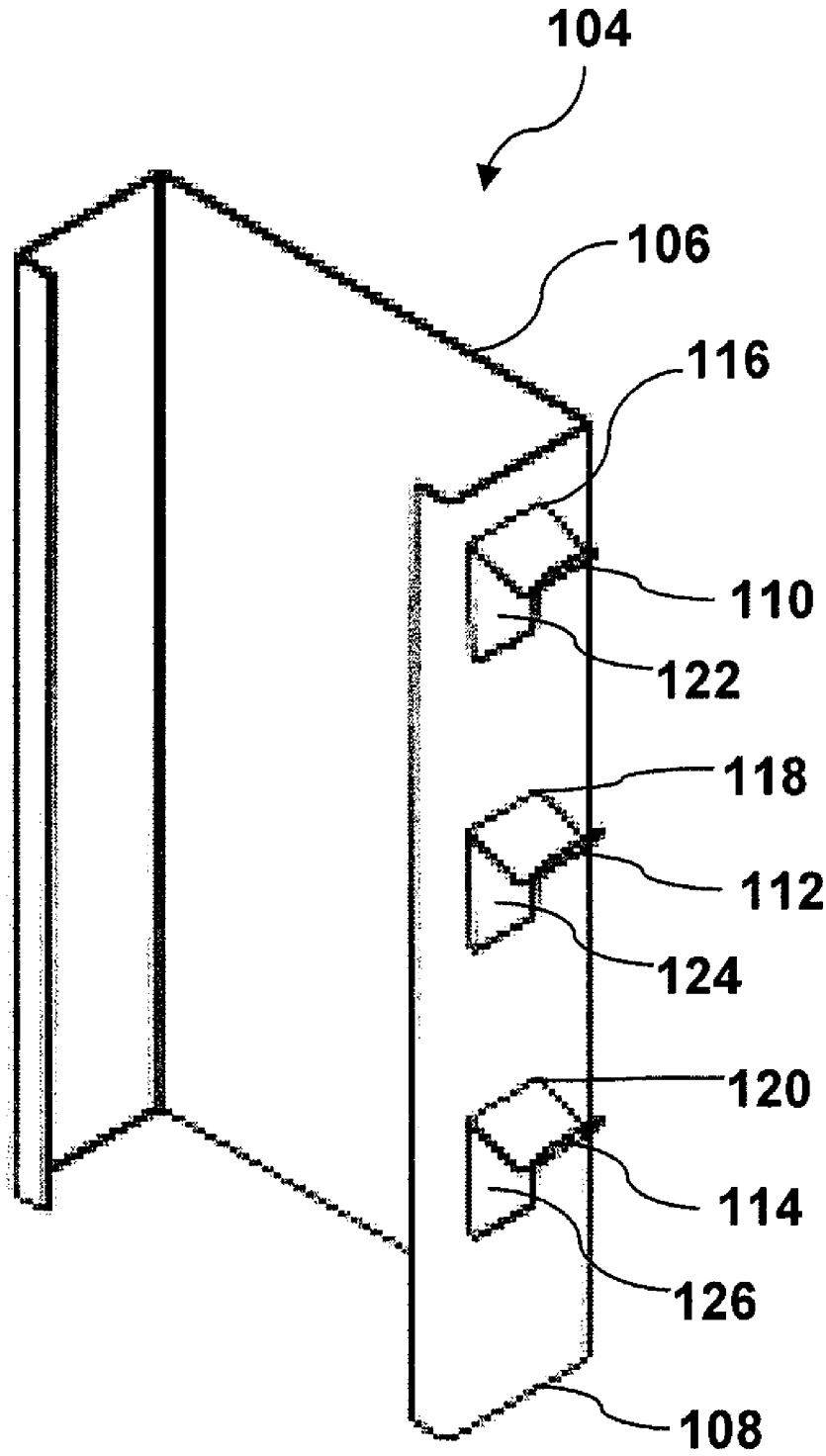
FIG. 5 is a partial isometric view of one embodiment of the present structural studs.

Another embodiment of the structural stud of the present invention is shown in FIG. 5. In this embodiment, the structural stud 104 comprises a baseplate 106, a sidewall 108, a plurality of tabs 110, 112, and 114 punched out of the sidewall 108, and a plurality of holes 122, 124, and 126 created by the tabs 110, 112, and 114 punched out of the sidewall 108. In some embodiments, the plurality of tabs 110, 112, and 114 is spaced such that the gaps between successive ones of tab leg connections 116, 118, and 120 are anywhere from about 1 to about 24 inches, including about 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, and 23.5 inches, or any range derivable within these numbers. In some embodiments, the gaps between successive ones of tab leg connections 116, 118, and 120 are less than about six inches, which further results in improved adhesion between the structural stud and the surrounding concrete. In other embodiments the gaps between successive ones of tab leg connection 116, 118, and 120 are about four inches.

While FIG. 5 only depicts three tabs in the sidewall of the structural stud, the number of tabs, the sizes of the tabs, and the spacing of the tabs can vary depending on the size, thickness, and tensile strength of the structural stud. For example, the embodiments described above where the gaps between successive tab leg connections are less than about six inches, and in particular about four inches, encompass a structural stud where the width of the baseplate 106 is about 6 inches, the width of the sidewall 108 is about 2 inches, and the stud is composed of steel that is 16 gauge in thickness and has a tensile strength of 50 ksi (i.e., kilo-pound per square inch). For studs of different sizes and/or steel thicknesses and tensile strengths, the sizes of the gaps can be proportionally scaled.

Other steel thicknesses that are suitable for use in certain embodiments of the structural studs of the present invention include 8, 9, 10, 11, 12, 14, 18, and 20 gauge steel. Other steel tensile strengths that are suitable for use in certain embodiments of the structural studs of the present invention include 33, 34, 35, 36, 37, 38, 39, 40, 41, 42, 43, 44, 45, 46, 47, 48, 49, 50, 51, 52, 53, 54, and 55 ksi, or any range derivable within these numbers.

With regard to the size and number of the tabs, in some embodiments, the size and number of the tabs is such that the total surface area of the sidewall divided by the total surface area of the holes created by the tabs results in a ratio of less than about 9.6. More particularly, the ratio is any of the following: 9.6, 9.5, 9.4, 9.3, 9.2, 9.1, 9.0, 8.9, 8.8, 8.7, 8.6, 8.5, 8.4, 8.3, 8.2, 8.1, 8.0, 7.9, 7.8, 7.7, 7.6, 7.5, 7.4, 7.3, 7.2, 7.1, 7.0, 6.9, 6.8, 6.7, 6.6, 6.5, 6.4, 6.3, 6.2, 6.1, 6.0, 5.9, 5.8, 5.7, 5.6, 5.5, 5.4, 5.3, 5.2, 5.1, 5.0, 4.9, 4.8, 4.7, 4.6, 4.5, 4.4, 4.3, 4.2, 4.1, 4.0, 3.5, 3.0, 2.5, 2.0, and 1.5, or any range derivable within these numbers.

In other embodiments, the size and number of tabs is such that the total surface area of the holes created by the tabs is greater than about 10% of the total surface area of the sidewall. More particularly, the total surface area of the holes created by the tabs is any of the following percentages of the total surface area of the sidewall: 10.1%, 10.2%, 10.3%, 10.4%, 10.5%, 10.6%, 10.7%, 10.8%, 10.9%, 11.0%, 11.1%, 11.2%, 11.3%, 11.4%, 11.5%, 11.6%, 11.7%, 11.8%, 11.9%, 12.0%, 12.1%, 12.2%, 12.3%, 12.4%, 12.5%, 12.6%, 12.7%, 12.8%, 12.9%, 13.0%, 13.1%, 13.2%, 13.3%, 13.4%, 13.5%, 13.6%, 13.7%, 13.8%, 13.9%, 14.0%, 14.1%, 14.2%, 14.3%, 14.4%, 14.5%, 14.6%, 14.7%, 14.8%, 14.9%, 15.0%, 15.1%, 15.2%, 15.3%, 15.4%, 15.5%, 15.6%, 15.7%, 15.8%, 15.9%, 16.0%, 17%, 18%, 19%, 20%, 25%, 30%, 35%, 40%, 45%, 50%, 55%, 60%, 65%, or 70%, or any range derivable within these numbers.

In some embodiments, the present invention comprises methods and devices for forming a structural stud. The device used in certain embodiments of the method comprises a punch and die mechanism to form the tabs in the sidewall of the structural stud according to certain embodiments of the present invention. A major advantage of some embodiments of these methods and devices is that only one strike by the punch and die mechanism is needed to form the tabs of the present structural studs. An embodiment of the tabs formed by the methods and devices are depicted in FIGS. 1-4. One embodiment of the method comprises striking the sidewall 103 of the stud 101 with a punch and forcing the punch into a die, creating a tab 105 punched out of the sidewall 103. The tab 105 comprises a tab leg 107 that is substantially planar and is connected to the sidewall 103 at one end of the tab leg 107. The tab leg 107 projects outwardly from the sidewall 103 at an angle of less than ninety degrees to the sidewall 103. The tab 105 also comprises a tab foot 109 extending from the tab leg 107 and curving away from a hole 111 in the sidewall 103 created by the tab 105 punched out of the sidewall 103. In some embodiments, the hole in the sidewall is defined by a base side 113 and a top side 115, the base side has a greater length than the top side, and the tab leg 107 extends from the base side 113. The tapered shape of the hole in the sidewall allows for better clearance of the die that forms the tab in the structural stud.

Figure 6:
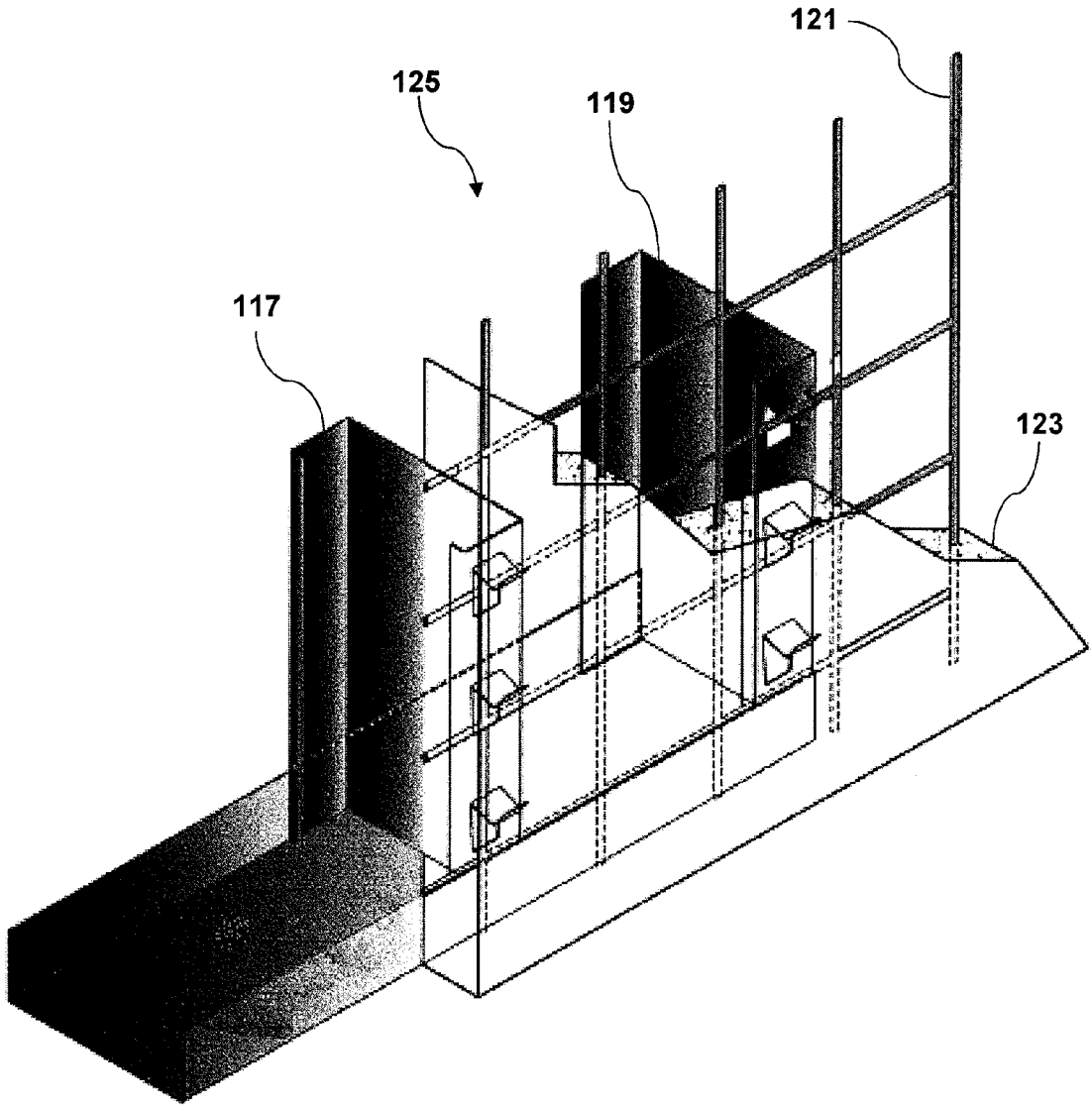
FIG. 6 is a partial cutaway perspective view of a tilt-wall panel formed according to one embodiment of the present methods.
Figure 7:
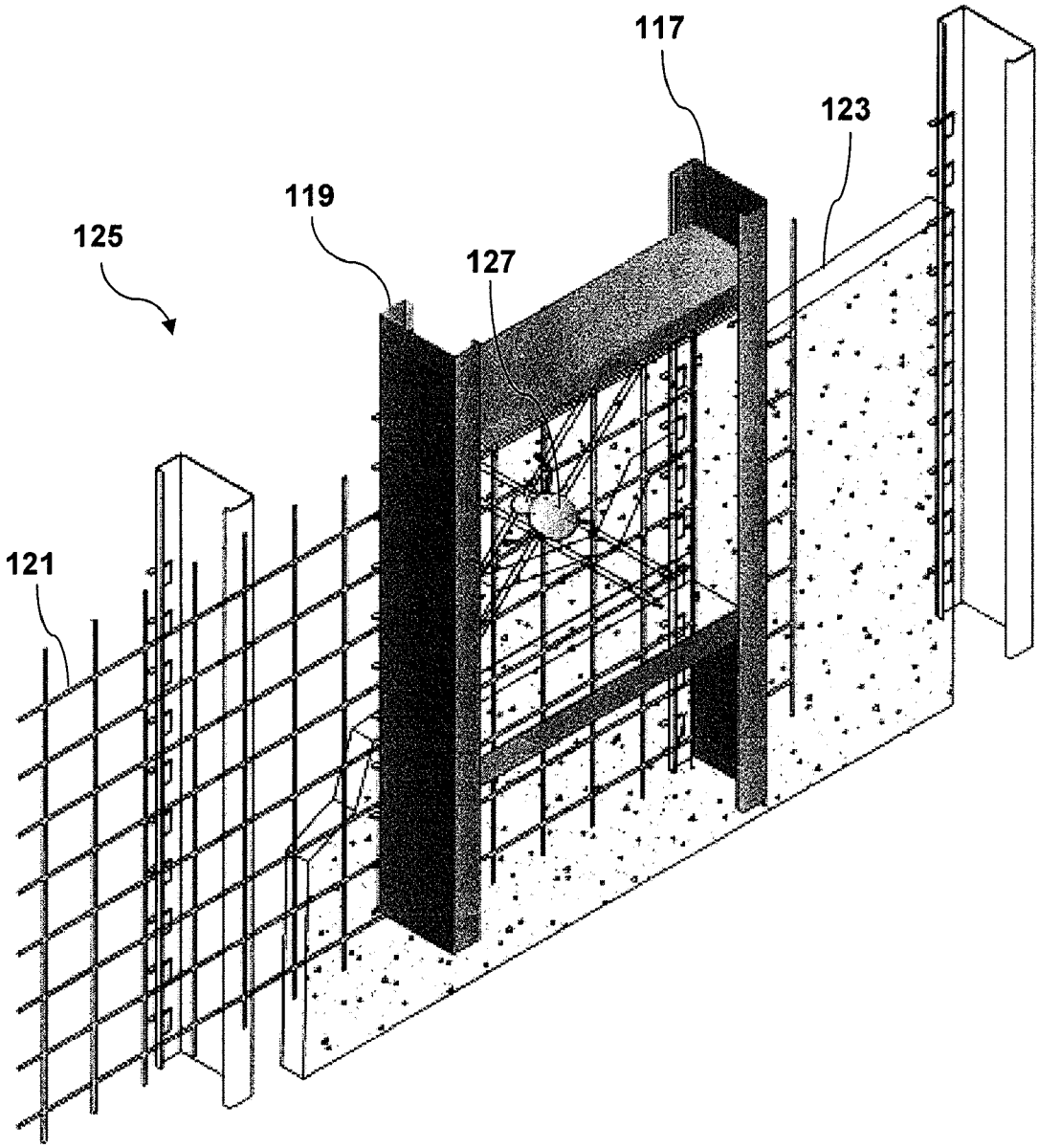
FIG. 7 is a partial cutaway perspective view of a tilt-wall panel formed according to one embodiment of the present methods.
Figure 8:
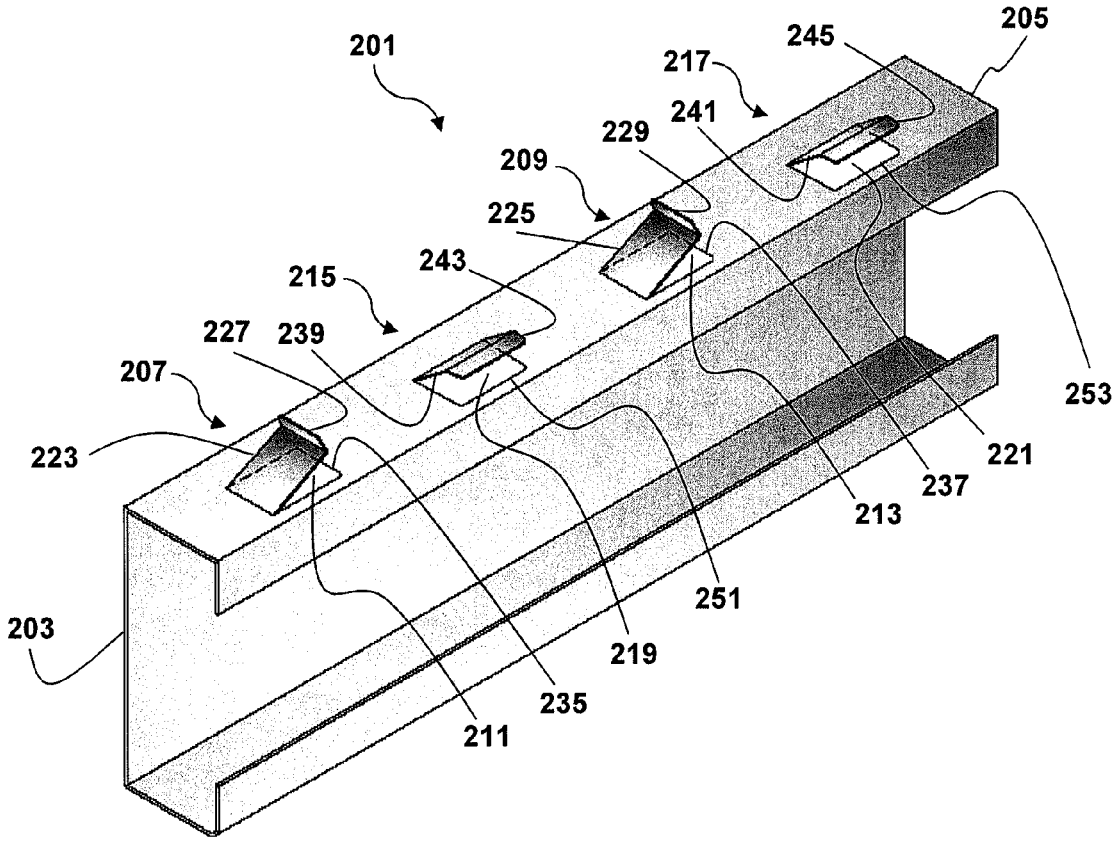
FIG. 8 is an isometric view of another embodiment of the present structural studs.
Figure 9:
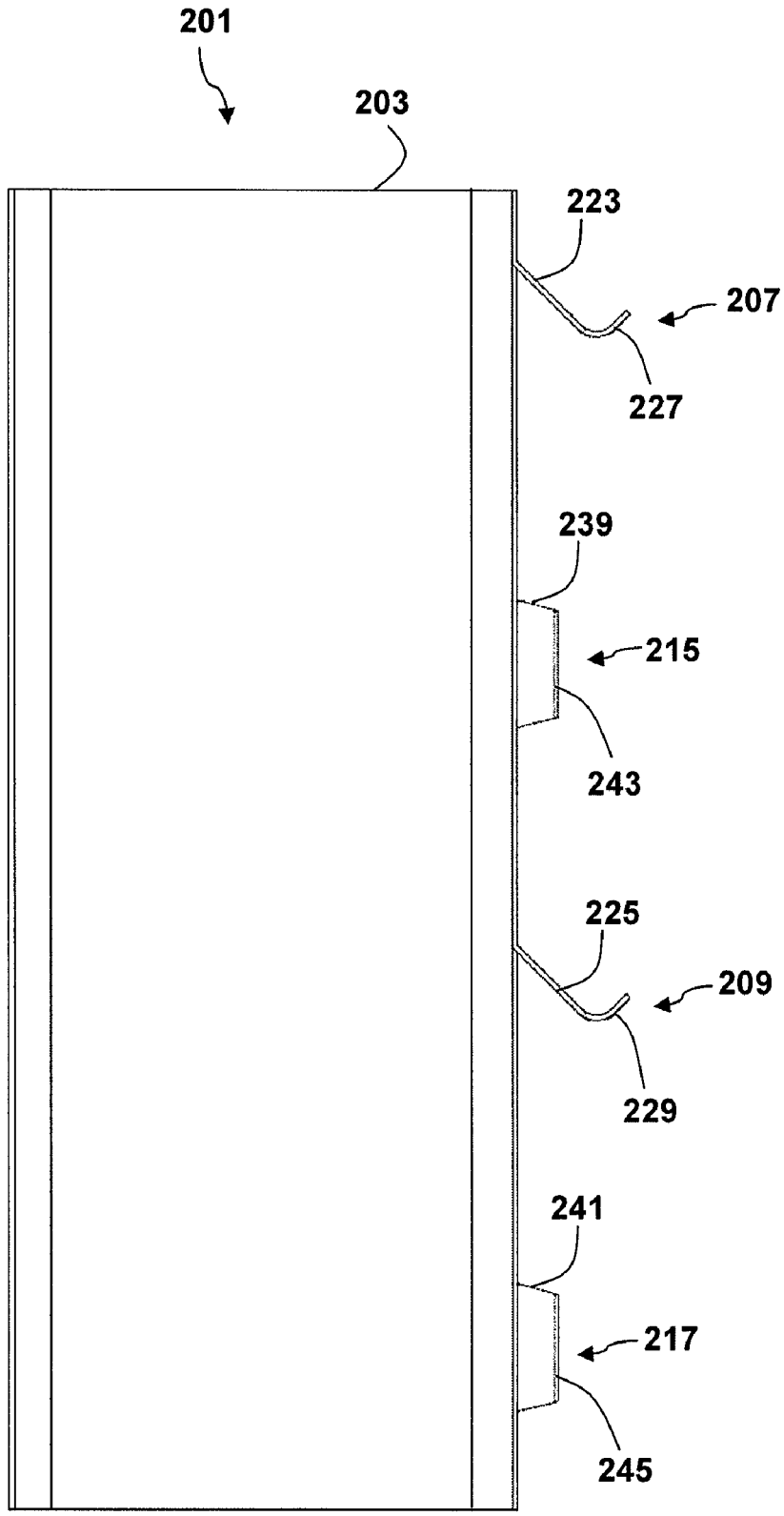
FIG. 9 is a side view of another embodiment of the present structural studs.
Figure 10:
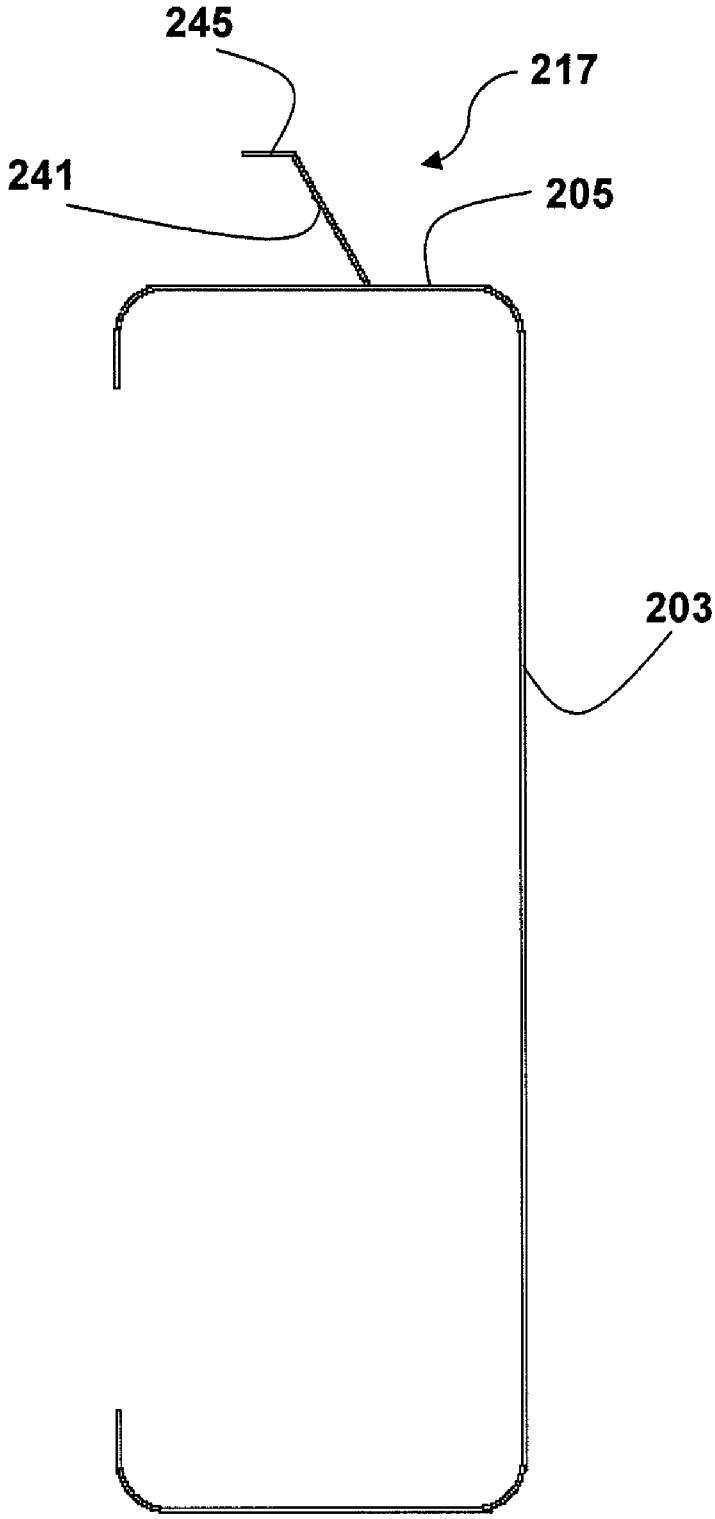
FIG. 10 is a front view of another embodiment of the present structural studs.
Figure 11:
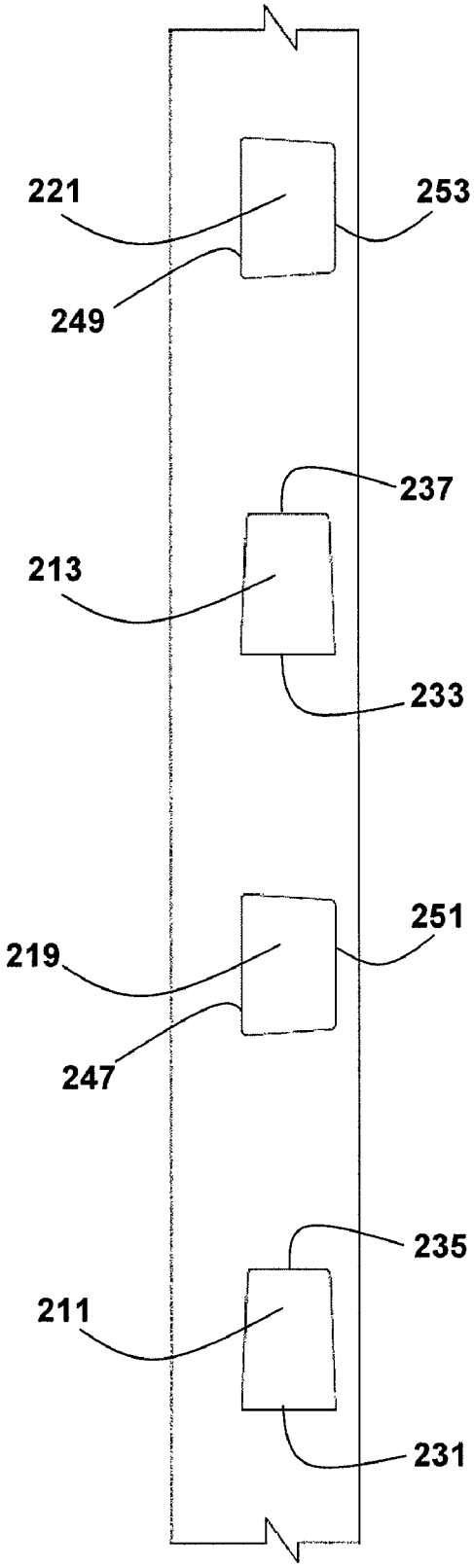
FIG. 11 is a top view of another embodiment of the present structural studs.

The present invention also provides a method of building a tilt-wall building that incorporates embodiments of the structural stud described above. Embodiments of a tilt-wall panel formed according to certain embodiments of the present method are depicted in FIGS. 6-7. As shown in FIGS. 6-7, these embodiments comprise obtaining a plurality of the present structural studs 117 and 119 and combining the plurality of structural studs 117 and 119 with a structural mesh 121 (such as a rebar network) on a substantially horizontal surface such that the studs and mesh are substantially parallel to each other and to the substantially horizontal surface and there are voids formed between the studs. The method further comprises embedding the structural studs 117 and 119 and structural mesh 121 in concrete 123 (or a suitable alternative material) to form a panel 125. The panel 125 is then raised such that it is substantially perpendicular to the ground and forms a wall or part of a wall. In some embodiments, the method further comprises laying lifting anchors 127 in the voids formed between the structural studs 117 and 119 prior to embedding the structural studs and structural mesh in concrete, embedding the structural studs 117 and 119, structural mesh 121, and lifting anchors 127 in concrete to form a panel 125, such that a portion of each lifting anchor 127 is exposed, and using the lifting anchors 127 to raise the panel 125 such that it is substantially perpendicular to the ground. In other embodiments, the method further comprises laying support anchors in the voids formed between the structural studs prior to embedding the structural studs and structural mesh in concrete, embedding the structural studs, structural mesh, and support anchors in concrete to form a panel, such that a portion of each support anchor is exposed, and attaching supports to the support anchors. In some embodiments, anywhere from 1 to 36 lifting anchors and/or support anchors are used to raise and/or support a panel, including 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, and 36 lifting anchors and/or support anchors, or any range derivable within these numbers. Those of skill in the art can determine the appropriate number of lifting anchors and/or support anchors, placement of the lifting anchors and/or support anchors, and manner of attaching the lifting anchors to the lifting apparatus and/or the support anchors to the support apparatus for a given panel size to safely and efficiently raise a panel into position and/or support the panel once it is raised into position without having the panel break under its own weight during the lifting and/or supporting process.

Another embodiment of the structural stud of the present invention is shown in FIGS. 8-11. In this embodiment, the structural stud 201 comprises a baseplate 203, a sidewall 205, a plurality of vertical tabs 207 and 209 punched out of the sidewall 205, a plurality of vertical holes 211 and 213 created by the vertical tabs 207 and 209 punched out of the sidewall 205, a plurality of horizontal tabs 215 and 217 punched out of the sidewall 205, and a plurality of horizontal holes 219 and 221 created by the horizontal tabs 215 and 217 punched out of the sidewall 205.

The vertical tabs 207 and 209 comprise tab legs 223 and 225 that are substantially planar and are connected to the sidewall 205 at one end of the tab legs 223 and 225. The tab legs 223 and 225 project outwardly from the sidewall 205 at an angle of less than ninety degrees to the sidewall 205. Having the tab legs 223 and 225 project outwardly at an angle of less than ninety degrees results in improved adhesion between the structural stud and the surrounding concrete. The vertical tabs 207 and 209 also comprise tab feet 227 and 229 extending from the tab legs 223 and 225 and curving away from vertical holes 211 and 213 created by the vertical tabs 207 and 209 punched out of the sidewall 205. Having the tab feet 227 and 229 curve away from the vertical holes 211 and 213 in the sidewall 205 further results in improved adhesion between the structural stud and the surrounding concrete. In some embodiments, the vertical holes 211 and 213 in the sidewall 205 are defined by base sides 231 and 233 and top sides 235 and 237, the base sides have a greater length than the top sides, and the tab legs 223 and 225 extend from the base sides 231 and 233.

The horizontal tabs 215 and 217 comprise tab legs 239 and 241 that are substantially planar and are connected to the sidewall 205 at one end of the tab legs 239 and 241. The tab legs 239 and 241 project outwardly from the sidewall 205 at an angle of less than ninety degrees to the sidewall 205. Having the tab legs 239 and 241 project outwardly at an angle of less than ninety degrees results in improved adhesion between the structural stud and the surrounding concrete. The horizontal tabs 215 and 217 also comprise tab feet 243 and 245 extending from the tab legs 239 and 241 and curving toward horizontal holes 219 and 221 created by the horizontal tabs 215 and 217 punched out of the sidewall 205. Having the tab feet 243 and 245 curve toward the horizontal holes 219 and 221 in the sidewall 205 further results in improved adhesion between the structural stud and the surrounding concrete. In some embodiments, the horizontal holes 219 and 221 in the sidewall 205 are defined by base sides 247 and 249 and top sides 251 and 253, the base sides have a greater length than the top sides, and the tab legs 239 and 241 extend from the base sides 247 and 249. In the embodiment shown in FIGS. 8-11, base sides 247 and 249 and top sides 251 and 253 for horizontal holes 219 and 221 are substantially perpendicular to base sides 231 and 233 and top sides 235 and 237 for vertical holes 211 and 213. Thus, the ends of vertical tab legs 223 and 225 connected to the sidewall 205 are substantially perpendicular to the ends of horizontal tab legs 239 and 241 connected to the sidewall 205. This substantially perpendicular arrangement results in further improved adhesion between the structural stud and the surrounding concrete and makes panels that comprise the stud and concrete combination more resistant to shear stress.

In the embodiment shown in FIGS. 8-11, the vertical tabs 207 and 209 and vertical holes 211 and 213 and the horizontal tabs 215 and 217 and horizontal holes 219 and 221 are positioned in an alternating arrangement on sidewall 205 such that there is a horizontal tab and horizontal hole between each vertical tab and vertical hole. In some embodiments, the horizontal holes and the vertical holes are spaced such that the distance between the centers of successive vertical and horizontal holes is anywhere from about 1 to about 24 inches, including about 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, and 23.5 inches, or any range derivable within these numbers. In some embodiments, the distance between the centers of successive vertical and horizontal holes is less than about 6 inches, which further results in improved adhesion between the structural stud and the surrounding concrete. In other embodiments the distance between the centers of successive vertical and horizontal holes is about four inches.

While FIGS. 8-11 only depict four tabs in the sidewall of the structural stud, the number of tabs, the sizes of the tabs, and the spacing of the tabs can vary depending on the size, thickness, and tensile strength of the structural stud. For example, the embodiments described above where the distance between the centers of successive vertical and horizontal holes is less than about six inches, and in particular about four inches, encompass a structural stud where the width of the baseplate 203 is about 6 inches, the width of the sidewall 205 is about 2 inches, and the stud is composed of steel that is 16 gauge in thickness and has a tensile strength of 50 ksi (i.e., kilo-pound per square inch). For studs of different sizes and/or steel thicknesses and tensile strengths, the distances between the holes can be proportionally scaled. Other steel thicknesses that are suitable for use in certain embodiments of the structural studs of the present invention include 8, 9, 10, 11, 12, 14, 18, and 20 gauge steel. Other steel tensile strengths that are suitable for use in certain embodiments of the structural studs of the present invention include 33, 34, 35, 36, 37, 38, 39, 40, 41, 42, 43, 44, 45, 46, 47, 48, 49, 50, 51, 52, 53, 54, and 55 ksi, or any range derivable within these numbers.

All of the methods and devices disclosed and claimed herein can be made and executed without undue experimentation in light of the present disclosure. While the methods and devices of this invention have been described in terms of preferred embodiments, it will be apparent to those of skill in the art that variations may be applied to the methods and devices and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The claims are not to be interpreted as including means-plus- or step-plus-function limitations, unless such a limitation is explicitly recited in a given claim using the phrase(s) "means for" or "step for," respectively.

What is claimed is:

1. A structural stud comprising:

a baseplate;

first and second sidewalls projecting from opposite edges of the baseplate; and at least two tabs each punched out of the first sidewall, one of the tabs being a vertical tab and the other tab being a horizontal tab;

the vertical tab comprising:

a tab leg that is substantially planar and is connected to the first sidewall at one end of the tab leg, and that projects away from the second sidewall at an angle of less than ninety degrees to the first sidewall; and a tab foot having a proximal portion and a distal portion, the proximal portion extending from the tab leg of the vertical tab and curving away from a vertical hole in the first sidewall resulting from the vertical tab punched out of the first sidewall in a direction toward a plane, said plane being perpendicular to the first sidewall and passing through said one end of the tab leg, the distal portion spaced apart from the tab leg of the vertical tab and being farther away from the vertical hole than the proximal portion; and the horizontal tab comprising:

a tab leg that is substantially planar and is connected to the first sidewall at one end of the tab leg, and that projects away from the second sidewall at an angle of less than ninety degrees to the first sidewall; and a tab foot extending from the tab leg of the horizontal tab and curving either away from or toward a horizontal hole in the first sidewall resulting from the horizontal tab punched out of the first sidewall;

where the end of the vertical tab leg that is connected to the first sidewall is substantially perpendicular to the end of the horizontal tab leg that is connected to the first sidewall.

2. The structural stud of claim 1, where:

the vertical hole is defined by a base side and a top side, the base side has a greater length than the top side, and the vertical tab leg the extends from the base side; and the horizontal hole is defined by a base side and a top side, the base side has a greater length than the top side, and the horizontal tab leg the extends from the base side.

3. The structural stud of claim 1, where the structural stud comprises a plurality of vertical tabs and resulting vertical holes and horizontal tabs and resulting horizontal holes.

4. The structural stud of claim 3, where the vertical tabs and vertical holes and the horizontal tabs and horizontal holes are positioned in an alternating arrangement on the sidewall such that there is a horizontal tab and horizontal hole between each vertical tab and vertical hole.

5. The structural stud of claim 4, where the horizontal holes and the vertical holes are spaced such that the distance between the centers of successive vertical and horizontal holes is less than about 6 inches.

6. The structural stud of claim 5, where the horizontal holes and the vertical holes are spaced such that the distance between the centers of successive vertical and horizontal holes is about 4 inches.

* * * * *

UNITED STATES PATENT AND TRADEMARK OFFICE

CERTIFICATE OF CORRECTION

PATENT NO. : 7,823,350 B2
APPLICATION NO. : 11/673356
DATED : November 2, 2010
INVENTOR(S) : John J. Valle et al.

It is certified that error appears in the above-identified patent and that said Letters Patent is hereby corrected as shown below:

In title page, item (54) Title and in column 1, line 1, delete "STRUCTUAL STUD" and insert --STRUCTURAL STUD-- therefor.

Signed and Sealed this
Fifteenth Day of February, 2011

David J. Kappos

David J. Kappos
*Director of the United States Patent and Trademark Office*